US007128406B2

(12) United States Patent
Dixon et al.

(10) Patent No.: US 7,128,406 B2
(45) Date of Patent: Oct. 31, 2006

(54) DROPLET DEPOSITION APPARATUS

(75) Inventors: Michael J. Dixon, Ely (GB); Steven Temple, Cambridge (GB); Howard J. Manning, Edinburgh (GB)

(73) Assignee: Xaar Technology Limited, Cambridge (GB)

( * ) Notice: Subject to any disclaimer, the term of this patent is extended or adjusted under 35 U.S.C. 154(b) by 34 days.

(21) Appl. No.: 09/875,619

(22) Filed: Jun. 6, 2001

(65) Prior Publication Data

US 2002/0118256 A1 Aug. 29, 2002

Related U.S. Application Data

(63) Continuation of application No. PCT/GB99/04433, filed on Dec. 24, 1999.

(30) Foreign Application Priority Data

Dec. 24, 1998 (GB) ..... 9828476.3

(51) Int. Cl.
*B41J 2/175* (2006.01)
*B41J 2/165* (2006.01)

(52) U.S. Cl. ..... 347/85; 347/22

(58) Field of Classification Search ..... 347/84, 347/85, 89, 92, 94, 46, 22
See application file for complete search history.

(56) References Cited

U.S. PATENT DOCUMENTS 4,011,157 A * 3/1977 Pennebaker et al. ..... 210/718
4,317,124 A 2/1982 Shirato et al. ..... 346/140 R
4,433,341 A 2/1984 Thomas ..... 346/140 R
4,734,711 A * 3/1988 Piatt et al. ..... 347/17
4,835,554 A 5/1989 Hoisington et al. ..... 346/140 R
5,087,930 A * 2/1992 Roy et al. ..... 347/85
5,087,931 A 2/1992 Rawson ..... 346/140 R
5,097,275 A * 3/1992 Takita ..... 347/56
5,189,438 A 2/1993 Hine et al. ..... 346/1.1
5,453,770 A 9/1995 Katakura et al. ..... 347/85
5,481,284 A 1/1996 Kitahara et al. ..... 347/42
5,489,925 A 2/1996 Brooks et al. ..... 347/6

(Continued)

FOREIGN PATENT DOCUMENTS

EP 0 277 703 A1 8/1988

(Continued)

OTHER PUBLICATIONS

International Search Report in PCT/GB99/04433 dated May 23, 2000.

(Continued)

*Primary Examiner*—Stephen Meier
*Assistant Examiner*—Leonard Liang
(74) *Attorney, Agent, or Firm*—Marshall, Gerstein & Borun LLP

(57) ABSTRACT

Droplet deposition apparatus comprises an array of fluid chambers, each chamber communicating with an orifice for droplet ejection, a common fluid inlet manifold and a common fluid outlet manifold, and means for generating a fluid flow into the inlet manifold, through each chamber in the array and into the outlet manifold, the fluid flow through each chamber being sufficient to prevent foreign bodies in the fluid from lodging in the orifice. Each chamber is associated with means for effecting droplet ejection from the orifice simultaneously with the fluid flow through the chamber. The resistance to flow of one of the inlet and outlet manifolds is chosen such that the pressure at a fluid inlet to any chamber in the array varies between any two chambers by an amount less than that which would give rise to significant differences in droplet ejection properties between these two chambers.

10 Claims, 10 Drawing Sheets

U.S. PATENT DOCUMENTS

| | | | | |
|---|---|---|---|---|
| 5,602,574 | A * | 2/1997 | Williams | 347/43 |
| 5,818,485 | A * | 10/1998 | Rezanka | 347/89 |
| 5,969,736 | A * | 10/1999 | Field et al. | 347/85 |
| 6,039,442 | A * | 3/2000 | Hagiwara et al. | 347/89 |
| 6,820,966 | B1 * | 11/2004 | Drury et al. | 347/57 |

FOREIGN PATENT DOCUMENTS

| | | |
|---|---|---|
| EP | 0 278 590 A1 | 8/1988 |
| EP | 0 622 210 A1 | 11/1994 |
| EP | 0 666 177 A2 | 8/1995 |
| EP | 0 714 778 A1 | 6/1996 |
| EP | 0 714 779 A2 | 6/1996 |
| EP | 0 810 093 A2 | 12/1997 |
| EP | 0 855 274 A2 | 7/1998 |
| JP | 51-77036 | 7/1976 |
| JP | 02-000520 | 1/1990 |
| JP | 03-184872 | 8/1991 |
| JP | 06-143601 | 5/1994 |
| WO | WO 91/17051 | 11/1991 |
| WO | WO 97/04963 | 2/1997 |
| WO | WO 98/52763 | 11/1998 |
| WO | WO 99/19147 | 4/1999 |

OTHER PUBLICATIONS

International Preliminary Examination Report in PCT/GB99/04433 dated Apr. 3, 2001.

* cited by examiner

DROPLET DEPOSITION APPARATUS

This is a continuation of International Application No. PCT/GB99/04433 filed Dec. 24, 1999, the entire disclosure of which is incorporated herein by reference.

The present invention relates to apparatus for depositing droplets of fluid and comprising an array of fluid chambers, each chamber communicating with an orifice for droplet ejection, with a common fluid inlet manifold and with a common fluid outlet manifold; together with means for generating a fluid flow into said inlet manifold, through each chamber in the array and into said outlet manifold. In particular, the present invention relates to inkjet printheads having such a construction and in which the fluid flow is ink.

Such an inkjet printhead is known from WO91/17051, incorporated herein by reference. FIG. 1 of the present application is taken from this document and shows a sectional view taken along the longitudinal axis of a printhead channel 11 formed in a base 12 of piezoelectric material. Ink ejection from the channel is via a nozzle 22 formed in a cover 60, whilst ink is supplied to the channel by means of manifolds 32,33 arranged at either end of the channel. As known, for example from EP-A-0 277 703 and EP-A-0 278 590, piezoelectric actuator walls are formed between successive channels and are actuated by means of electric fields applied between electrodes on opposite sides of each wall so as to deflect transversely in shear mode. The resulting pressure waves generated in the ink cause ejection of a droplet from the nozzle. As is also known, ink may be fed into one and out of the other of the manifolds 32,33 so as to generate ink flow through the channel and past the nozzle during printhead operation. This acts to prevent the accumulation of dust, dried ink or other foreign bodies in the nozzle that would otherwise inhibit ink droplet ejection.

In the course of experiments with such printheads supplied with ink at a rate considered sufficient to prevent foreign bodies from aggregating in the nozzle, it has been discovered that droplet ejection characteristics—particularly the size and speed of the ejected droplets—have varied along the array. It has been established that this variation is a result of a variation in the rest position of the ink meniscus in each chamber along the array, which is in turn caused by variations in the static pressure at the nozzle in each chamber in the array.

The present inventors have discovered that this variation in pressure is due to the continuous flow of ink, particularly the flow of ink in the manifolds running alongside the array of channels which is equal (at least at the inlet and outlet to the manifolds) to the total ink flow through every channel in the array. Such flow can give rise to significant viscous pressure losses along both inlet and outlet manifolds. This in turn affects the static pressure at the inlet and outlet to each chamber and hence the static pressure at the nozzle of the chamber.

In its preferred embodiments, the present invention seeks to solve these and other problems.

In a first aspect, the present invention provides droplet deposition apparatus comprising:

an array of fluid chambers, each chamber communicating with an orifice for droplet ejection, a common fluid inlet manifold and a common fluid outlet manifold; and means for generating a fluid flow into the inlet manifold, though each chamber in the array and into the outlet manifold, the fluid flow through each chamber being sufficient to prevent foreign bodies in the fluid from lodging in the orifice;

wherein each chamber is associated with means for effecting droplet ejection from the orifice simultaneously with the fluid flow through the chamber, the resistance to flow of at least one of the inlet and outlet manifolds being chosen such that the static pressure at a fluid inlet to any chamber in the array varies between any two chambers by an amount less than that which would give rise to significant differences in droplet ejection properties between the two chambers in the array.

Reducing the flow resistance of one of the inlet and outlet manifolds to below a threshold can ensure that any viscous pressure losses that do occur as a result of ink circulation do not adversely affect the uniformity of droplet ejection characteristics over the width of the array. As a result, a uniform image quality across the printed width of the substrate is more easily achieved.

In one preferred construction, the inlet manifold has a resistance to flow less than that which would give rise to a variation in static pressure between the inlets to any two chambers in the array sufficient to produce significant differences in droplet ejection properties between the two chambers in the array.

In another preferred construction, the resistance to flow of the outlet manifold is chosen such that the pressure at a fluid inlet to any chamber in the array varies between any two chambers by an amount less than that which would give rise to significant differences in droplet ejection properties between the two chambers in the array.

Preferably, the resistance to flow of each of the inlet and outlet manifolds is chosen such that the pressure at the orifice of any chamber in the array varies between any two chambers by an amount less than that which would give rise to significant differences in droplet ejection properties between the two chambers in the array. Since the pressure at a chamber nozzle is influenced by the static pressure at both the inlet and outlet to the chamber (it will generally lie midway between the two, neglecting any difference between the flow in and flow out of the chamber due to droplet ejection), reducing the flow resistance of both manifolds to below appropriate threshold values will ensure that neither inlet nor outlet pressure varies in such a way as to cause significant pressure differences between the nozzles of successive chambers in the array. Variation in image quality over the width of the printhead is thereby reduced to such a level as to be insignificant.

Therefore, in a second aspect the present invention provides droplet deposition apparatus comprising:

an array of fluid chambers, each chamber communicating with an orifice for droplet ejection, a common fluid inlet manifold and a common fluid outlet manifold; and means for generating a fluid flow into the inlet manifold, though each chamber in the array and into the outlet manifold, the fluid flow through each chamber being sufficient to prevent foreign bodies in the fluid from lodging in the orifice;

wherein each chamber is associated with means for effecting droplet ejection from the orifice simultaneously with the fluid flow through the chamber, the resistance to flow of the inlet and outlet manifolds is chosen such that the static pressure at the orifice of any chamber in the array due to the flow varies between any two chambers by an amount less than that which would give rise to significant differences in droplet ejection properties between the two chambers in the array.

In one preferred arrangement, the cross-sectional area of at least one of the inlet and outlet manifolds is such that the pressure varies between any two chambers by an amount less than that which would give rise to significant differences in droplet ejection properties between the two chambers in the array.

The array of chambers may be linear. The two chambers may be located adjacent one another in the array, or may be located remote from one another in the array.

The array may be angled to the horizontal and the inlet manifold may extends parallel to the array, the properties of the inlet manifold varying in a direction lying parallel to the array in such a way as to substantially match the rate of pressure loss along the inlet manifold due to viscous losses in the inlet manifold to the rate of increase of static pressure along the inlet manifold due to gravity. As a result, image quality can remain uniform over the whole height of the chamber array in spite of a difference in head of ink between the top and bottom chambers of the array.

Therefore, in a third aspect the present invention provides droplet deposition apparatus comprising:

an array of droplet fluid chambers angled to the horizontal, each chamber being supplied with droplet fluid from a common fluid manifold extending parallel to the array; and means for generating a fluid flow into each chamber of the array;

wherein properties of the inlet manifold varying in a direction lying parallel to the array in such a way as to substantially match the rate of pressure loss along the manifold due to viscous losses in the manifold to the rate of increase of static pressure along the manifold due to gravity.

In a preferred arrangement, the cross-sectional area of the inlet manifold varies perpendicular to the longitudinal direction of the array of chambers.

The apparatus may comprise a common fluid outlet manifold for the array of chambers. If so, the cross-sectional area of the outlet manifold may vary perpendicular to the longitudinal direction of the array of chambers. There may be provided means for generating a fluid flow into the common fluid manifold, through each chamber in the array and into the common fluid outlet manifold.

In a preferred arrangement the array is arranged substantially vertically. Thus, the uniform image quality may extend over as much as 12.6 inches (32 cm) in the case of a vertical printhead for printing an A3-size substrate.

In apparatus of the kind described above, ink is typically supplied from a reservoir arranged above the printhead and flows to a reservoir arranged below the printhead, from where it is returned to the upper reservoir b means of a pump. When the printhead is idle and the pump is switched off, ink drains from the upper reservoir into the lower reservoir via the printhead (and, sometimes, the pump) such that when the printhead is re-activated, the ink level in the upper tank must be re-established before printing can commence. This can take some time, depending on the size of the pump.

In a fourth aspect, the present invention provides droplet deposition apparatus comprising:

at least one droplet fluid chamber communicating with a first fluid reservoir located above the at least one chamber and with a second fluid reservoir located below the chamber;

pump means for conveying fluid from the second fluid reservoir to the first fluid reservoir; and means for preventing the flow of fluid from the first to the second fluid reservoir when the pump means is not operating.

The present inventors have established that in ink supply systems of the kind described above and in which the reservoirs are open to atmosphere, control of the fluid level in each reservoir is critical to operation of the printhead. The upper reservoir is generally chosen so as to provide sufficient static pressure to overcome the viscous resistance to ink flow in the section of the chamber between the chamber inlet and the orifice. At the same time, it must not be so great that the pressure at the nozzle overcomes the surface tension of the ink meniscus and causes ink to "weep" from the nozzle—indeed, a slightly negative pressure at the nozzle is to be preferred. The lower reservoir must similarly exert sufficient negative pressure at the chamber outlet to ensure ink flow. However, as with the upper reservoir, the negative pressure exerted must not be so great as to break the ink meniscus in the nozzle.

Therefore, in a preferred embodiment the apparatus comprises pump control means for controlling the pump in dependence on the fluid level in the first fluid reservoir.

Thus, in a fifth aspect the present invention provides droplet deposition apparatus comprising:

at least one droplet fluid chamber communicating with a first fluid reservoir located above the at least one chamber and with a second fluid reservoir located below the chamber;

pump means for conveying fluid from the second fluid reservoir to the first fluid reservoir; and pump control means for controlling the pump in dependence on the fluid level in the first fluid reservoir.

The pump control means may comprise a fluid level sensor located in the first fluid reservoir and is adapted to control the pump means in dependence on an output from the fluid level sensor.

The apparatus may comprise temperature control means for controlling the temperature of fluid conveyed from the second fluid reservoir to the first fluid reservoir. This can ensure that ink is ejected from the apparatus at the optimum temperature, and therefore at the optimum viscosity, regardless of the ambient temperature.

Thus in a sixth aspect the present invention provides droplet deposition apparatus comprising:

at least one droplet fluid chamber communicating with a first fluid reservoir located above the at least one chamber and with a second fluid reservoir located below the chamber;

means for conveying fluid from the second fluid reservoir to the first fluid reservoir; and temperature control means for controlling the temperature of fluid conveyed from the second fluid reservoir to the first fluid reservoir.

The temperature of the ink may rise as it passes through the printhead due to heat emitted from drive circuitry of the printhead. Therefore, in a preferred embodiment, the temperature control means comprises means for reducing the temperature of fluid conveyed from the at least one chamber to the first fluid reservoir, preferably from the second reservoir to the first reservoir. This can ensure that ink at a temperature higher than the optimum temperature is not conveyed to the printhead.

The apparatus may comprise a conduit for conveying fluid from the first fluid reservoir to the at least one droplet fluid chamber, the temperature control means comprising a temperature sensor located in the conduit and being adapted to control the temperature of fluid conveyed from the second fluid reservoir to the first fluid reservoir depending on an output from the temperature sensor.

In one preferred arrangement, the apparatus comprises means for conveying fluid from the first fluid reservoir to the second fluid reservoir when the fluid level in the first fluid reservoir exceeds a given level. This can prevent "overflowing" of the first reservoir.

Therefore, in a seventh aspect, the present invention provides droplet deposition apparatus comprising:

at least one droplet fluid chamber communicating with a first fluid reservoir located above the at least one chamber and with a second fluid reservoir located below the chamber;

means for conveying fluid from the second fluid reservoir to the first fluid reservoir; and means for conveying fluid from the first fluid reservoir to the second fluid reservoir when the fluid level in the first fluid reservoir exceeds a given level.

The means for conveying fluid from the first fluid reservoir to the second fluid reservoir may comprise a conduit extending between the first and second reservoirs and having an inlet in the first fluid reservoir above the given level.

In one embodiment, the apparatus comprises means for supplying fluid to the second fluid reservoir, and fluid supply control means for controlling the supply of the fluid to the second fluid reservoir depending on the fluid level in the second fluid reservoir. This can ensure that the second reservoir does not overflow.

In an eighth aspect, the present invention provides droplet deposition apparatus comprising:

at least one droplet fluid chamber communicating with a first fluid reservoir located above the at least one chamber and with a second fluid reservoir located below the chamber;

means for conveying fluid from the second fluid reservoir to the first fluid reservoir;

means for supplying fluid to the second fluid reservoir; and fluid supply control means for controlling the supply of the fluid to the second fluid reservoir depending on the fluid level in the second fluid reservoir.

The fluid supply control means may comprise a fluid level sensor located in the second fluid reservoir and is adapted to control the supply of fluid to the second fluid reservoir in dependence on an output from the fluid level sensor.

In one arrangement, the apparatus comprises a third fluid reservoir communicating with the second fluid reservoir, and means for conveying fluid from the third reservoir to the second reservoir in dependence on the fluid level in the second fluid reservoir.

In a ninth aspect, the present invention provides droplet deposition apparatus comprising:

at least one droplet fluid chamber communicating with a first fluid reservoir located above the at least one chamber and with a second fluid reservoir located below the chamber;

means for conveying fluid from the second fluid reservoir to the first fluid reservoir;

a third fluid reservoir communicating with the second fluid reservoir; and means for conveying fluid from the third reservoir to the second reservoir in dependence on the fluid level in the second fluid reservoir.

The apparatus may comprise means for conveying fluid from the second fluid reservoir to the at least one droplet fluid chamber.

Thus, in a tenth aspect, the present invention provides droplet deposition apparatus comprising:

at least one droplet fluid chamber communicating with a first fluid reservoir located above the at least one chamber and with a second fluid reservoir located below the chamber;

pump means for conveying fluid from the second fluid reservoir to the first fluid reservoir, and from the second fluid reservoir to the at least one droplet fluid chamber.

In a preferred arrangement, the apparatus comprises means for diverting the conveyance of fluid away from the first fluid reservoir to the at least one droplet fluid chamber.

The or each chamber may comprises a channel connected to the first and second fluid reservoirs at respective ends thereof, and to a nozzle for droplet ejection at a point intermediate the first and second ends.

There may be means connected between the respective ends of the channel for bypassing fluid flow around the channel.

Preferably the second reservoir has a large footprint (surface) area compared to its height, thereby enabling it to accommodate large variations in fluid volume with only a small change in head (liquid depth) in the reservoir. This can reduce variations in negative pressure in the chamber.

The present invention will now be described by way of example with reference to the accompanying drawings, in which.

Figure 2:
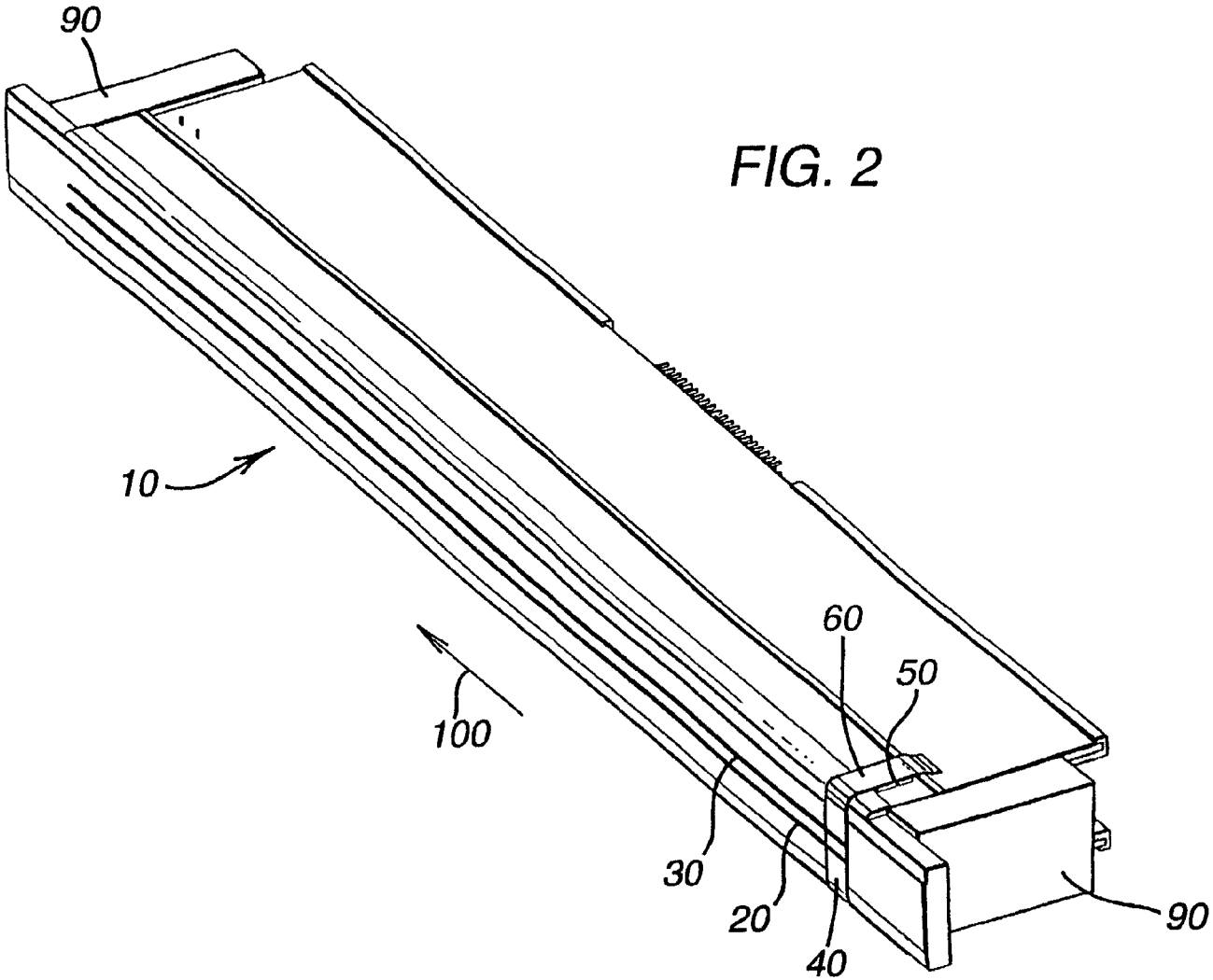
FIG. 2 is a perspective view of a "pagewide" printhead incorporating the first aspect of the invention.

FIG. 2 illustrates a first embodiment of a printhead 10 according to the first, second and third aspects of the present invention. The example shown is a "pagewide" device, having two rows of nozzles 20,30 that extend (in the direction indicated by arrow 100) the width of a piece of paper and which allow ink to be deposited across the entire width of a page in a single pass. Ejection of ink from a nozzle is achieved by the application of an electrical signal to actuation means associated with a fluid chamber communicating with that nozzle, as is known e.g. from EP-A-0 277 703, EP-A-0 278 590 and, more particularly, UK application numbers 9710530 and 9721555 incorporated herein by reference. To simplify manufacture and increase yield, the "pagewide" row(s) of nozzles may be made up of a number of modules, one of which is shown at 40, each module having associated fluid chambers and actuation means and being connected to associated drive circuitry (integrated circuit ("chip") 50) by means e.g. of a flexible circuit 60. Ink supply to and from the printhead is via respective bores (not shown) in endcaps 90.

Figure 3:
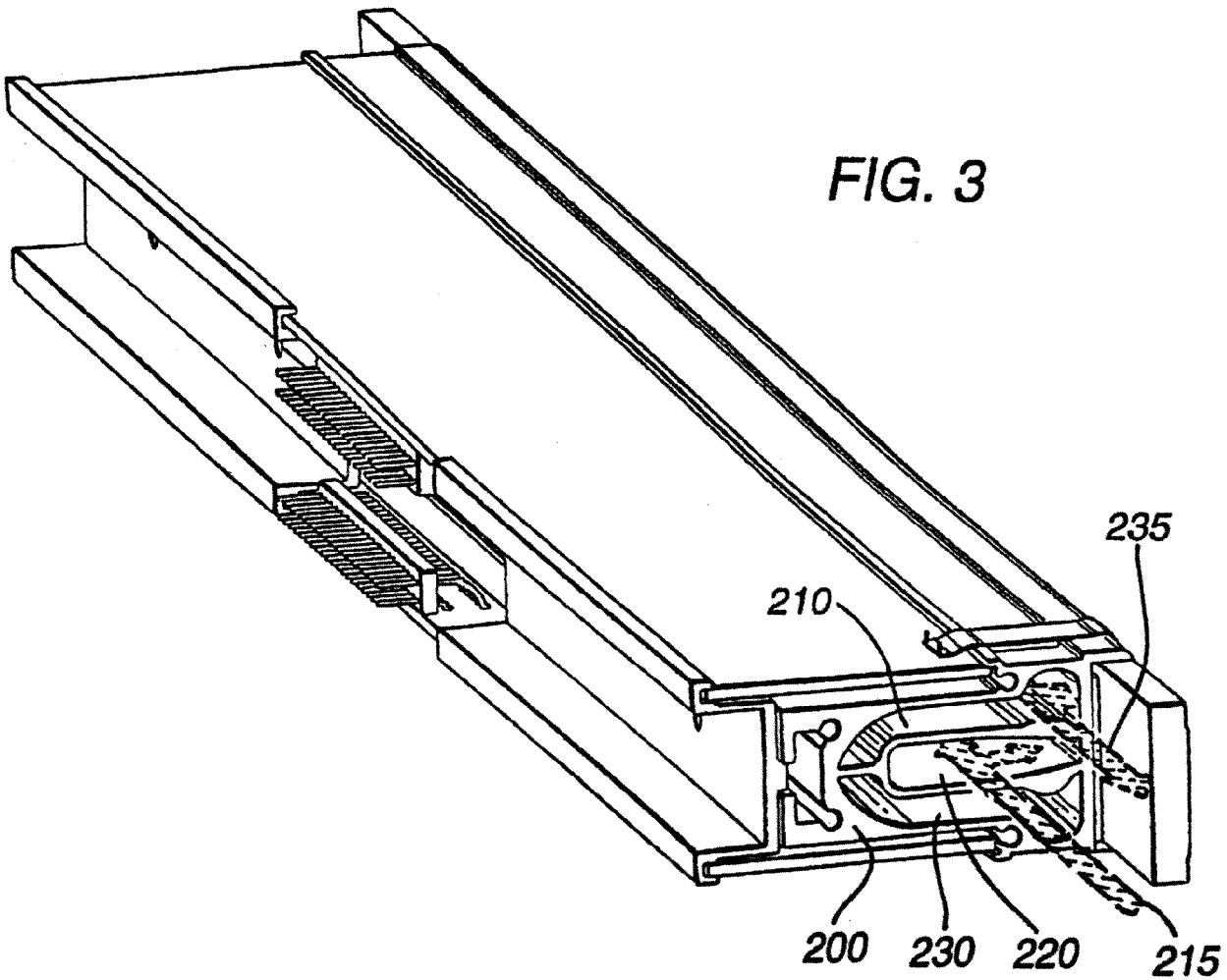
FIG. 3 is a perspective view from the rear and the top of the printhead of FIG. 2.
Figure 4:
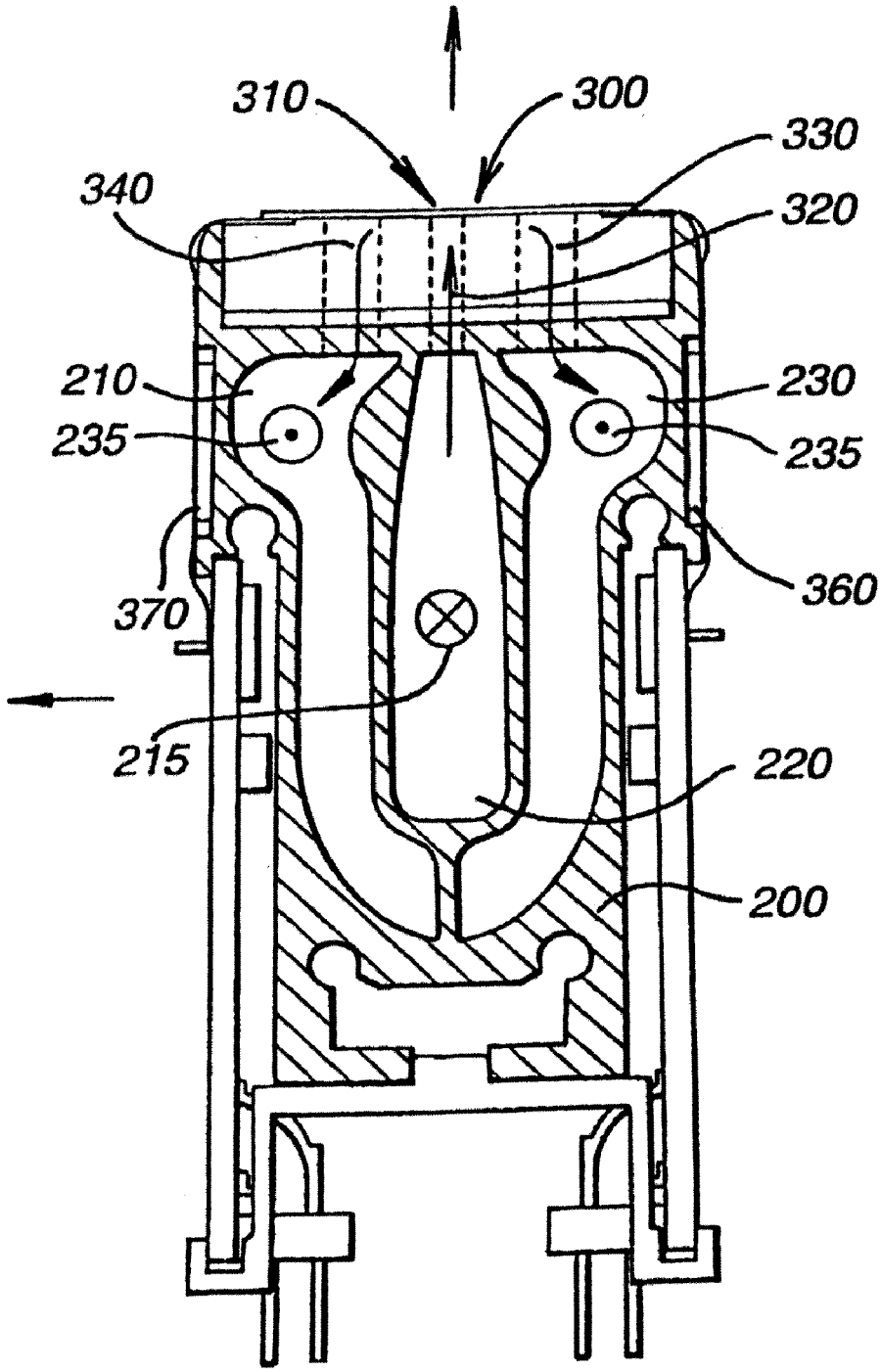
FIG. 4 is a sectional view of the printhead of FIGS. 2 and 3 taken perpendicular to the direction of extension XX of the nozzle rows XX.

FIG. 3 is a perspective view of the printhead of FIG. 2 from the rear and with endcaps 90 removed to reveal the supporting structure 200 of the printhead incorporating ink flow passages 210,220,230 extending the width of the printhead. Via a bore in one of the endcaps 90 (omitted from the views of FIGS. 2 and 3), ink enters the printhead and the ink supply passage 220, as shown at 215 in FIG. 3. As it flows along the passage, it is drawn off into respective ink chambers, as illustrated in FIG. 4, which is a sectional view of the printhead taken perpendicular to the direction of extension of the nozzle rows. From passage 220, ink flows into first and second parallel rows of ink chambers (indicated at 300 and 310 respectively) via aperture 320 formed in structure 200 (shown shaded). Having flowed through the first and second rows of ink chambers, ink exits via apertures 330 and 340 to join the ink flow along respective first and second ink outlet passages 210,230, as indicated at 235. These join at a common ink outlet (not shown) formed in the endcap and which may be located at the opposite or same end of the printhead to that in which the inlet bore is formed.

Each row of chambers 300 and 310 has associated therewith respective drive circuits 360, 370. The drive circuits are mounted in substantial thermal contact with that part of structure 200 acting as a conduit and which defines the ink flow passageways so as to allow a substantial amount of the heat generated by the circuits during their operation to transfer via the conduit structure to the ink. To this end, the structure 200 is made of a material having good thermal conduction properties. Of such materials, aluminium is particularly preferred on the grounds that it can be easily and cheaply formed by extrusion. Circuits 360,370 are then positioned on the outside surface of the structure 200 so as to lie in thermal contact with the structure, thermally conductive pads or adhesive being optionally employed to reduce resistance to heat transfer between circuit and structure.

To ensure effective cleaning of the chambers by the circulating ink and in particular to ensure that any foreign bodies in the ink, e.g. dirt particles, are likely to go past a nozzle rather than into it, the ink flow rate through a chamber must be high, for example ten times the maximum rate of ink ejection from the channel. This requires a correspondingly high flow rate in the manifolds that feed ink to and from the chamber. In accordance with the present invention, inlet and/or outlet manifolds are of sufficient cross-sectional area to ensure that, even at such a high rate of ink flow, any pressure losses along the length of the chamber array due to viscous effects are not significant.

As explained above, significant pressure losses in either or both manifolds may result in significant differences in static pressure at the nozzle between different chambers in the array. This in turn may result in differences in the rest position of the ink meniscus between chambers, which will in turn give rise to drop volume and velocity variations between channels. As is well known, these variations will result in print defects which, depending inter alia on the image being printed, on whether there is a significant variation between successive chambers in the array or only between chambers at opposite ends of the array, may be noticeable. In the present invention, the properties of the manifolds are chosen so as to avoid such defects.

For example, a printhead of the kind shown in FIGS. 2–4 typically produces 50 pl drops which, at a typical maximum ejection frequency of around 6 kHz, corresponds to a maximum flow rate through the nozzle of each chamber of 300 picolitres per second. Multiplied by the 4604 nozzles necessary to provide a pagewide printing width (typically 12.6 inches) at the standard resolution of 360 dots per inch results in a maximum ejection rate from the nozzles of a printhead of around 83 ml per minute.

Figure 1:
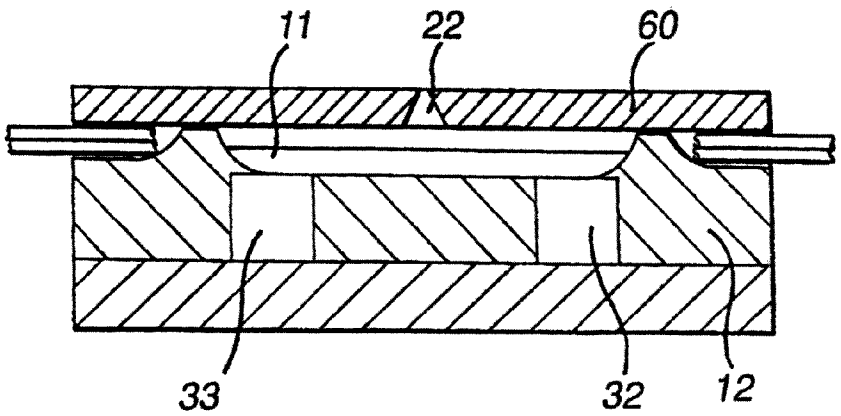
FIG. 1 (Prior art)
FIG. 1 is a sectional view of a known printhead taken along the longitudinal axis of a printhead channel.
Figure 5:
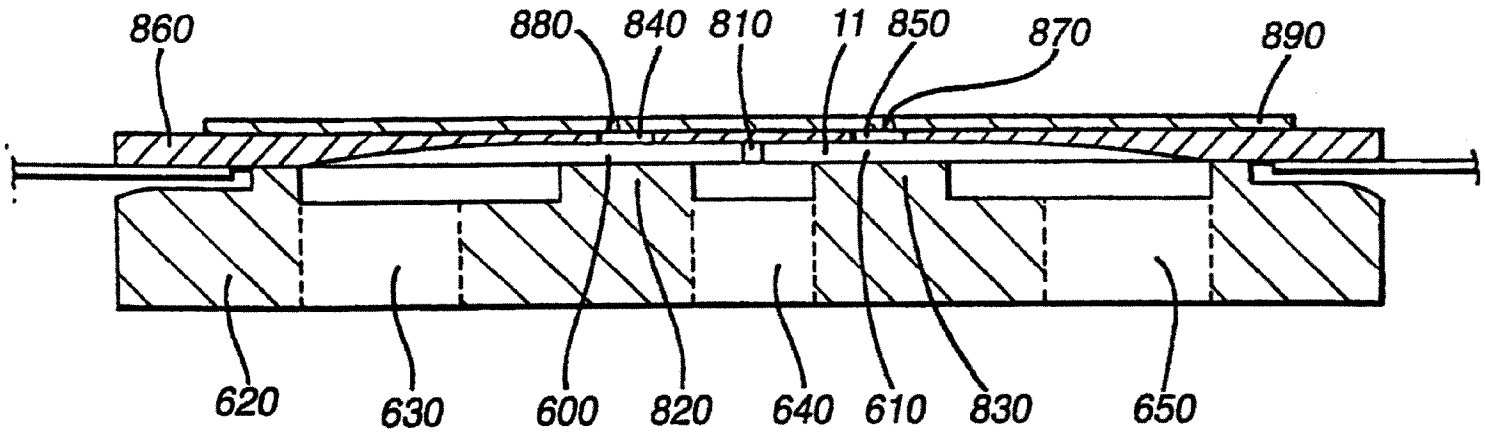
FIG. 5 is a sectional view taken along a fluid channel of an ink ejection module of the printhead of FIG. 1.

Further detail of the chambers and nozzles of the particular printhead of the example is given in FIG. 5, which is a sectional view taken along a fluid chamber of a module 40 (FIG. 2). The fluid chambers take the form of channels, 11, machined or otherwise formed in a base component 860 of piezoelectric material so as to define piezoelectric channel walls which are subsequently coated with electrodes, thereby to form channel wall actuators, as known e.g. from EP-A-0 277 703. Each channel half is closed along a length 600, 610 by respective sections 820, 830 of a cover component 620 which is also formed with ports 630, 640, 650 that communicate with fluid manifolds 210, 220, 230 (FIGS. 3 and 4) respectively. A break in the electrodes at 810 allows the channel walls in either half of the channel to be operated independently by means of electrical signals applied via electrical inputs (flexible circuits 60, see FIG. 2). Ink injection from each channel half is via openings 840, 850 that communicate the channel with the opposite surface of the piezoelectric base component to that in which the channel is formed. Nozzles 870, 880 for ink ejection are subsequently formed in a nozzle plate 890 attached to the piezoelectric component.

Reliability considerations demand that the rate at which ink is circulated through the printhead needs to substantially greater—up to ten times greater—than the ejection rate: as previously mentioned, this measure helps confine any foreign bodies in the ink to the main ink flow, reducing the likelihood of nozzle blockage. As a result, the total flow rate through the printhead of the example is of the order of 830 ml per minute. Ink ejection from the nozzles (which will vary with the image being printed) will of course reduce in a varying manner the amount the amount of ink flowing out of the printhead as compared with the amount of ink flowing in: however, as has already been seen, this difference is small in comparison with the overall ink circulation rate, so that it is true to say that the fluid flow rate through each chamber is substantially constant.

It will also be evident that the rate of fluid flow along the inlet manifold will decrease with distance along the array (and away from the inlet bore in one of the endcaps 90, (see FIG. 2) as the number of channels remaining to be supplied with fluid decreases. Similarly, the rate of fluid flow in the outlet manifolds will increase as the number of channels exhausting ink into those manifolds increases with distance along the array.

To accommodate maximum flow rates in both inlet and outlet manifolds without causing significant variations in the image quality printed by different channels in the array, the inlet and outlet manifolds of the example given have cross-sectional areas of $1.6\times10^{-4}$ m$^2$ and $1.2\times10^{-4}$ m$^2$ respectively. This typically gives a total pressure drop over the length of inlet manifold of the order of 136 Pa (the surface roughness of the manifolds has little effect, the flow being laminar). The corresponding pressure drop over the length of each of the outlet manifolds is typically of the order of 161 Pa.

As indicated above, the maximum flow rate—and thus the maximum pressure drop—occurs at the inlet and outlet connections of the inlet and outlet manifolds respectively. In the example given, the pressure drops at these locations also did not exceed that level at which differences in the image quality between successive channels became significant.

A further advantageous characteristic of the configuration of FIGS. 2–4 is the substantially rectangular cross-section of the manifolds which allows the sufficient flow area outlined above to be achieved, but not at the expense of making the printhead wider in the substrate travel direction (perpendicular to both the droplet ejection direction and the channel array direction).

Figure 6:
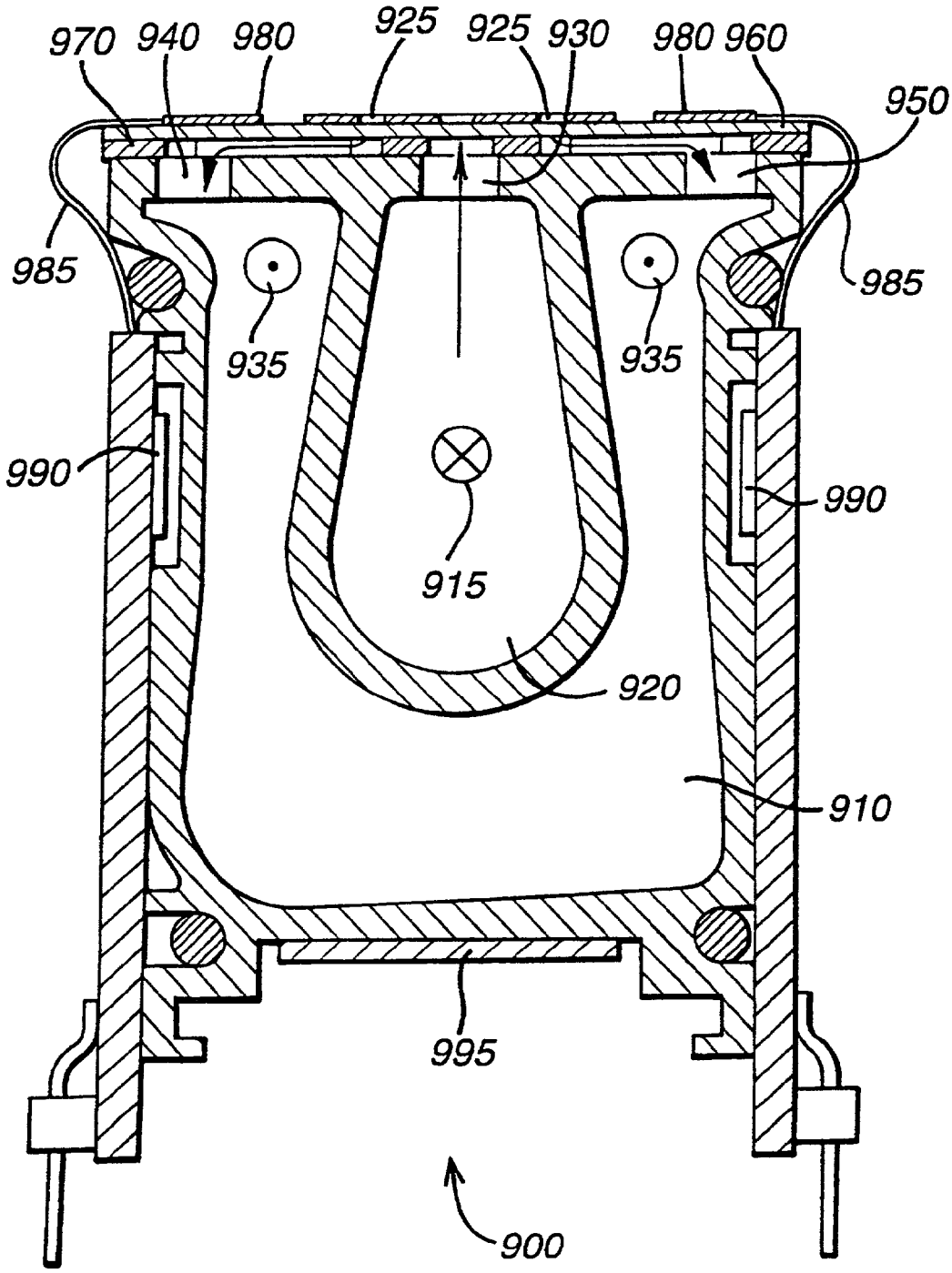
FIG. 6 is a sectional view of a second embodiment of a printhead taken perpendicular to the direction of extension of the nozzle rows.

FIG. 6 shows a sectional view of a second embodiment of droplet deposition apparatus taken perpendicular to the direction of extension of the nozzle rows. Similar to the first embodiment shown in FIG. 4, the supporting structure 900 of the printhead incorporates ink flow passages 910,920 extending the width of the printhead. Ink enters the printhead and the ink supply passage 920 as shown at 915 in FIG. 6. As it flows along the passage, it is drawn off into respective ink chambers 925 via aperture 930 formed in structure 900. Having flowed through the ink chambers, ink exits via apertures 940 and 950 to join the ink flow along ink outlet passage 910 as indicated at 935.

A flat alumina substrate 960 is mounted to the structure 900 via alumina interposer layer 970. The interposer layer 970 is preferably bonded to the structure 900 using thermally conductive adhesive, approximately 100 microns in thickness, the substrate 960 being in turn bonded to the interposer layer 970 using thermally conductive adhesive.

Chips 980 of the drive circuit are mounted on a low density flexible circuit board 985. To facilitate manufacture of the printhead, and reduce costs, the portions of the circuit board carrying the chips 980 are mounted directly on the surface of the alumina substrate 960. In order to avoid overheating of the drive circuit, other heat generating components of the drive circuit, such as resistors 990, are mounted in substantial thermal conduct with that part of the structure 900 acting as a conduit so as to allow a substantial amount of the heat generated by these components 990 during their operation to transfer via the conduit structure to the ink.

In addition to the alumina substrate and interposer layer, an alumina plate 995 is mounted to the underside of the structure 900 in order to limit expansion of the aluminium structure 900 at this position, thereby substantially preventing bowing of the structure due to thermal expansion.

Figure 7:
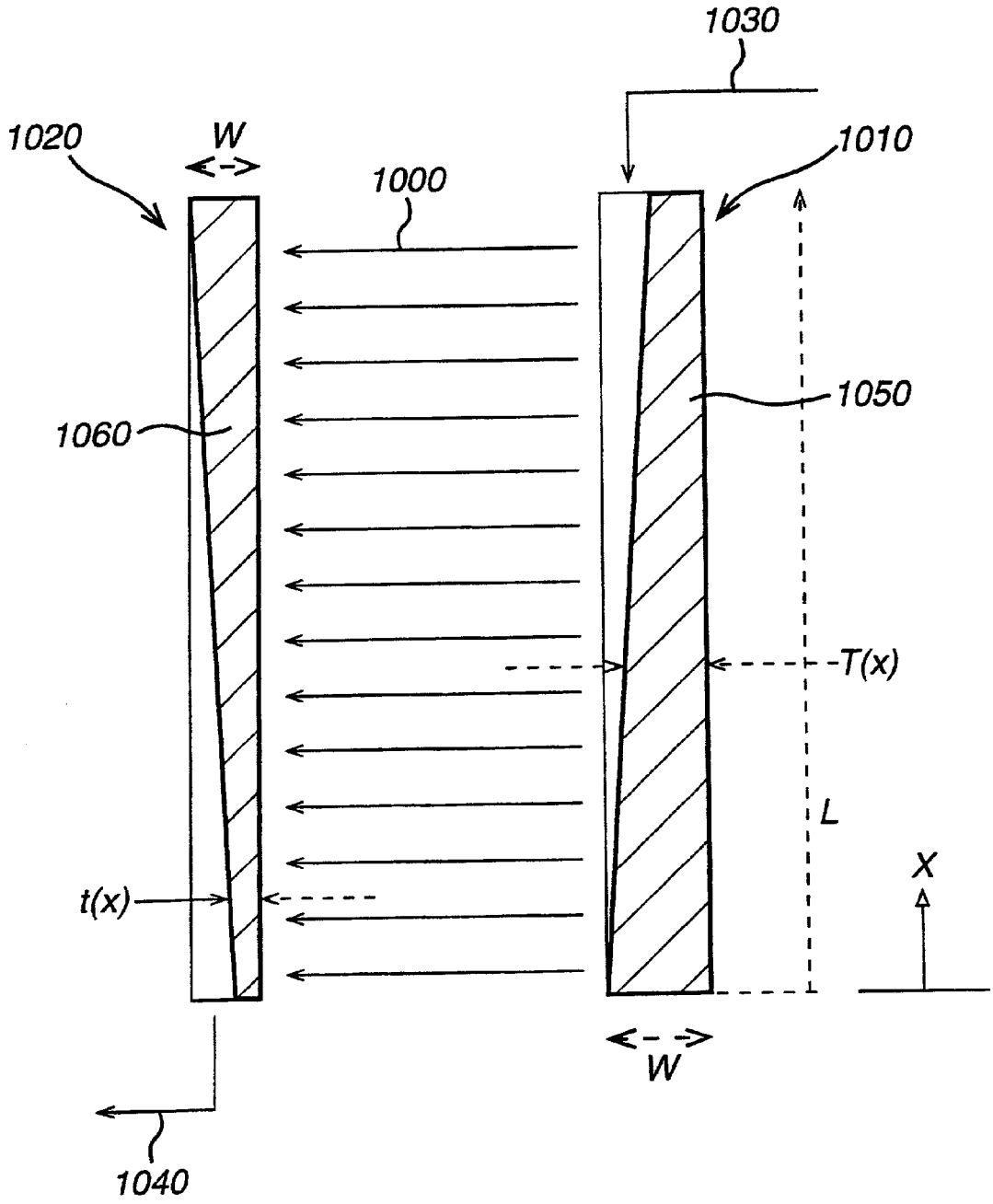
FIG. 7 is a schematic illustration of a printhead according to an aspect of the present invention.

FIG. 7 schematically illustrates a further aspect of the invention which applies, as illustrated, to printheads in which the linear array of droplet fluid chambers is arranged at a non-zero angle to the horizontal direction (i.e. at a non-perpendicular angle to the direction of gravity, indicated by arrow X in the figure). For the sake of clarity, only a single linear array of chambers is depicted by arrows 1000. However, the analysis that follows is based on an arrangement of a single inlet manifold 1010 and double outlet manifolds 1020 of the kind shown in FIGS. 2–5. Manifolds 1010,1020 are supplied with and drained of ink at connections 1030 and 1040 respectively.

In the embodiment shown, inserts having a tapered shape are placed in the inlet and outlet manifolds as indicated at 1050 and 1060 such that ink entering the inlet manifold at the top of the array finds that the tapered insert only blocks part of the cross-section of the manifold. As the ink passes down the manifold, some of it flows outwards via the channels 1000 to the outlet manifold 1020 such that, by the time the bottom of the array is reached, there is no ink flowing in the inner manifold and the tapered insert leaves no cross-section for flow. Ink reaching the outlet manifold also flows downwards, via cross-sections which increase towards the bottom by virtue of further tapered inserts. By the bottom of the array, all the ink (except that which has been ejected for printing) is flowing in the large space allowed by the inserts.

In each manifold, the viscous pressure drop per length down the array is balanced against the gravitational increase in pressure by arranging that the cross-section available for flow at each point is appropriate to the flow there. Taking the length of the array of chambers as L and the nozzle resolution per nozzle row as r, then the total number of nozzles in a two row printhead of the kind shown in FIGS. 2–5 is 2rL and the total ink ejection rate for the printhead is 2rLVf, where V and f are the volume and maximum frequency of droplet ejection respectively. The total flow rate through the printhead, on the other hand, needs to be a factor n—typically 10—times greater than the ejection rate due to cleaning considerations as mentioned above.

The tapered inserts according to the embodiment of FIG. 7 cause the flow rate in the inlet manifold to decrease according to the formula 2rVfnx (where x is the distance from the bottom of the array) and that in each outlet manifold to increase according to the formula rVfn(L−x). In combination with manifolds of generally rectangular cross-section, they will also typically give a cross-section available for ink flow at each point along the array that is rectangular, having a large dimension d (perpendicular to the plane of FIG. 7) and a smaller dimension (W−T(x)) for the inlet manifold and (w−t(x)) for the outlet manifold. Accordingly, the velocity v of the flow in each manifold varies along the array as 2rVfnx/(W−T(x)) for the inlet manifold and as rVfn(L−x)/(w−t(x)) for each of the outlet manifolds.

The pressure drop associated with flow along a tapering non-circular channel is determined by flow velocity v and ink density ρ in accordance with the general equation $K\rho v^2/2$. K is the resistance coefficient f(dx)/D for a short length of pipe dx having a laminar friction factor f=64/(Reynolds Number) and a hydraulic diameter D which, in the case of a rectangular cross-section, is approximately equal to twice the smaller dimension i.e. 2(W−T(x)) for the inlet manifold and 2(w−t(x)) for the outlet manifold.

In accordance with this aspect of the invention, the viscous pressure drop over a short element of length dx precisely balances the increase in static head due to gravity over that length and equal to ρg(dx), :g being the acceleration due to gravity. Applying this balance to the expressions for viscous loss given above yields expressions for the variation in manifold dimension necessary to achieve such balance, namely:

$$(W-T)^3=16nrfVx\mu/\rho gd$$

for the inlet manifold, and $$(w-t)^3=8nrfV(L-x)\mu/\rho gd$$

for each of the outlet manifolds. This in turn requires that the insert in the inlet manifold has to taper in such a way as to leave a width of passageway for the ink which varies as $x^{1/3}$ whilst the insert in the outlet manifold has to taper in a similar way but from the opposite end of the array. Exactly this variation may be difficult to achieve in practice, particularly if the insert is to be machined, in which case the an approximate variation obtained e.g. by a series of shims may prove acceptable.

Typical figures for a printhead of the kind shown in FIGS. 2–4 and discussed with regard to the first, second and third aspects of the invention are (W−T)=1.46 mm at the inlet (connection 1030 to ink supply) end of the inlet manifold 1010 and, similarly, (w−t)=1.16 mm at the outlet (connection 1040 to ink drain) end of each of the outlet manifolds 1020. These figures assume a manifold depth, d, of 40 mm, an ink density, ρ, of 900 kg/m$^3$ and an ink viscosity, μ, of 0.01 Pa.s. They also consider the flow through the channels to be substantially constant, neglecting any difference in flow between the two manifolds due to ink ejection.

The above invention allows, with appropriate adaptation of the manifolds, uniform ejection characteristics to be obtained across the array of a printhead arranged at any angle to the horizontal. It is not restricted to "pagewide" designs, although the potential for a large variation in static pressure across the array that would result were the present invention or alternative measures not employed, is particularly great in such printheads.

It should be noted that whilst variation of flow resistance has been achieved in the example by means of a variation in flow area, this is not the only mechanism available. Others of the parameters mentioned above, in particular the resistance coefficient K, can be varied e.g. by baffles in the manifold, by a variable roughness coating in the manifold. Furthermore, the concept may be employed more than once in a single array—the channels may be separated into two groups, as is known e.g. from WO97/04963, each of which has its own ink circulation system. The invention is also not restricted to systems employing ink circulation—a substantially constant flow of ink would also result from the situation where substantially all of the ink chambers were ejecting ink substantially all of the time.

Figure 8:
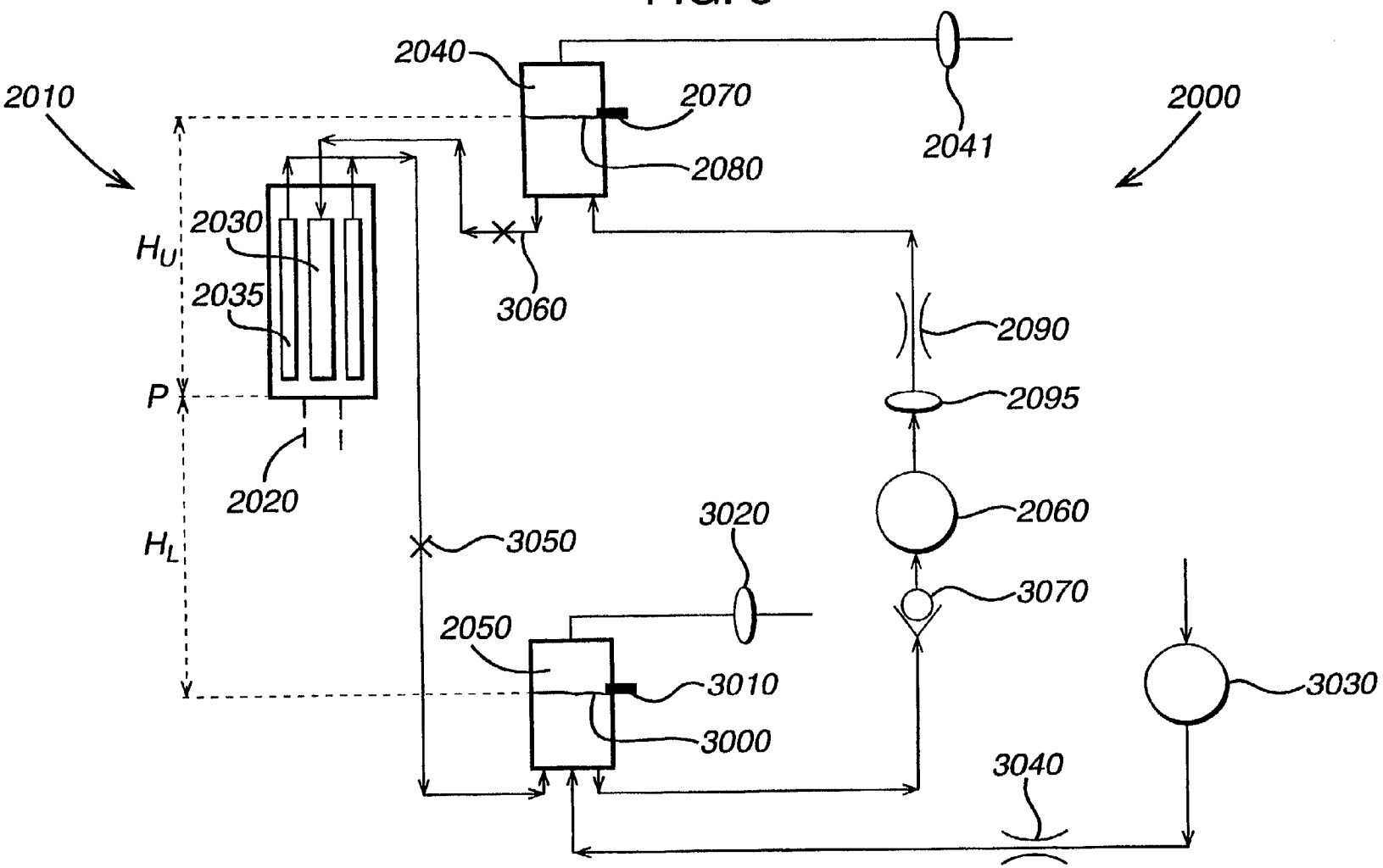
FIGS. 8, 9*a*, 9*b*, 10*a*, 10*b* and 11 are schematic illustrations of fluid supply systems according to further aspects of the invention and particularly suited for use with printheads of the kind described with reference to FIGS. 1 to 7.

Referring now to FIG. 8, there is depicted in a schematic fashion an ink supply system 2000 suitable for use with a through-flow printhead 2010 of the kind discussed above and incorporating a number of aspects of the present invention. Whilst printhead 2010 is shown with the channel array lying horizontal and the nozzles directed for downward ejection as indicated at 2020, it should be noted that the system is equally applicable to non-horizontal arrangements as discussed above.

Ink enters the central inlet manifold 2030 of the printhead from an upper reservoir 2040 open to the atmosphere via air filter 2041 and itself supplied with ink from a lower reservoir 2050 by means of a pump 2060. In accordance with an aspect of the present invention, pump 2060 is controlled by a sensor 2070 in the upper reservoir in such a manner as to maintain the fluid level 2080 therein a constant height Hu above the plane P of the nozzles. A restrictor 2090 prevents excessive flow rate, so that the cycling of the pump does not disturb the pressures established by the free surface 2080. A filter 2095 traps any foreign bodies that may have entered the ink supply, typically via the storage tank. A printhead of the kind discussed above and firing droplets of around 50 pl volume generally requires a filter that will trap particles of size 8 μm and above in order that these do not block the printhead nozzles which typically have a minimum (outlet) diameter of around 25 μm. Smaller drops, e.g. for use in so-called "multipulse" printing, will require correspondingly smaller nozzles (typically 20 μm diameter) and greater filtration.

In the lower reservoir 2050, the fluid level 3000 is maintained at a constant height HL below the nozzle plane P by a sensor 3010 which controls a pump 3030 connected to an ink storage tank (not shown). Filter 3020 and restrictor 3040 serve the same purpose as in the upper reservoir. Lower reservoir 2050 is connected to the outlet manifolds 2035 of the printhead.

As explained earlier, the positive pressure applied by the upper reservoir to the printhead inlet manifold together with the negative pressure applied by the lower reservoir to the printhead outlet manifold generates flow through the fluid chambers of the array sufficient to prevent accumulation of dirt without inappropriate pressures at the nozzles. In the example shown, utilising a printhead having the dimensions described above, values of around 280 mm for Hu and 320 mm for HL have been found to give a pressure at the nozzles of around −200 Pa. A slightly negative pressure of this kind ensures that the ink meniscus does not break, even when subject to mild positive pressure pulses that are typically generated during the operation of such heads (e.g. by the movement of ink supply tubes, vibration from the paper feed mechanism and the ink supply pumps, etc.). Means for controlling the various supply pumps to maintain the free surface levels in the reservoirs substantially constant contributes to such operation.

In accordance with an aspect of the present invention, valves 3050, 3060 are arranged in the ink supply lines to and from the printhead. Electrically connected to the printhead controller along with pumps 2060, 3030 and sensors 2070, 3010, they remain open during printhead operation but close when the printhead is shut off so as to prevent ink draining from the upper reservoir back to the lower reservoir. As a result, printing can be rapidly resumed when the printhead is next switched on. A non-return valve 3070 may also be installed in the supply line to pump 2060 where this is not of the positive displacement kind.

Figure 9A:
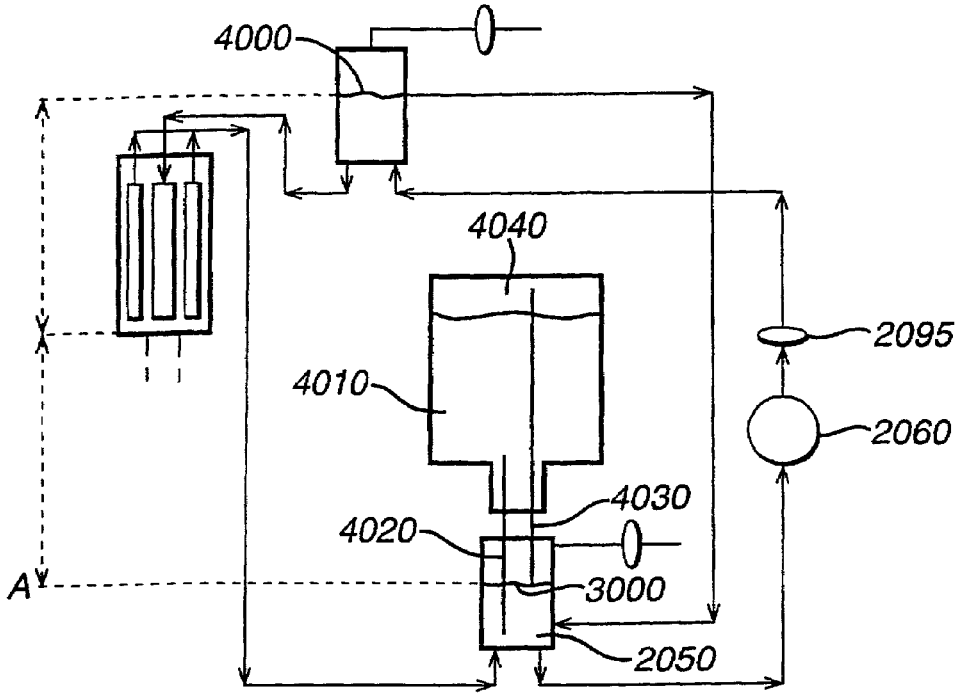

FIG. 9*a* illustrates an alternative ink supply arrangement to that of FIG. 8. Control circuitry is simplified by allowing the pump 2060 to run continuously, ink flowing back to the lower reservoir when the fluid level in the reservoir exceeds the level of an outlet 4000. An air-tight ink storage tank 4010 is mounted above the lower reservoir 2050 and connected thereto by a supply pipe 4020. A further pipe 4030 has one end communicating with the air space 4040 above the ink in the storage tank and another end located at the height of desired ink level A in the lower reservoir such that, when the actual ink level 3000 in the lower reservoir sinks below the desired level A, the end of pipe 4030 is uncovered, allowing air to flow into air space 4040 which in turn allows more ink to flow out of the tank via tube 4020 and into the lower reservoir 2050, thereby restoring the ink level to its desired value. As with the arrangement of FIG. 8, normally closed valves and non-return valves can be employed to ensure quick start up of printing after periods of non-use.

Figure 9B:
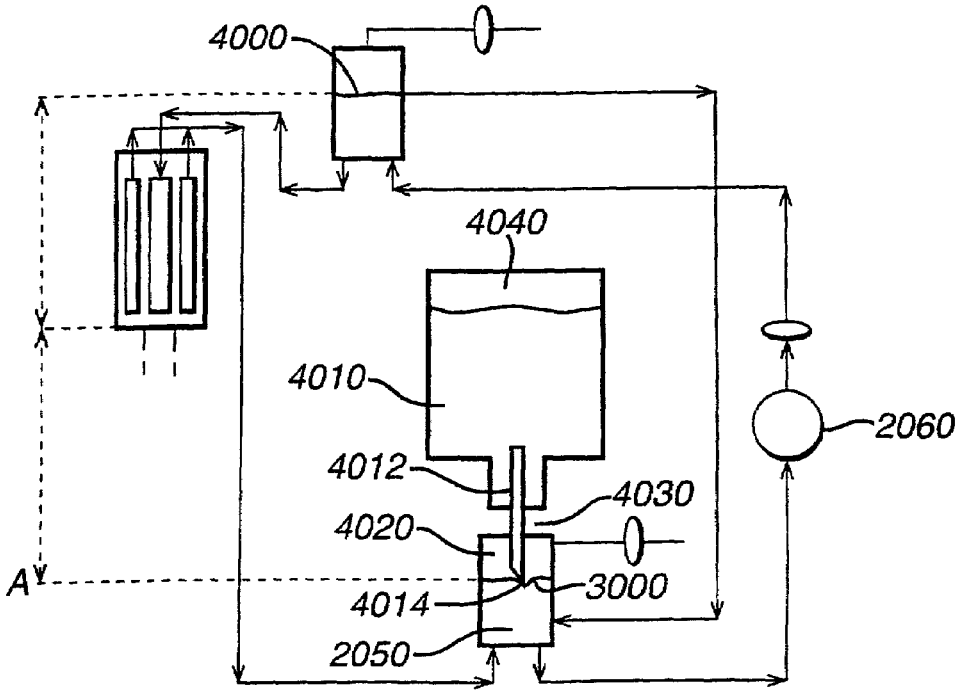

A modified and simpler version of the system of FIG. 9*a* is shown in FIG. 9*b*. A single large diameter tube 4012 extends between the sealed container 4010 and the lower reservoir 2050. This tube is arranged so that no part of it is horizontal, and has its lower end 4014 (preferably cut at an angle) in contact with the fluid in the lower reservoir 2050. The level of ink in the lower reservoir is set by this end. Initially, ink flows out of the sealed container 4010 until a vacuum is established in space 4040. Depletion of ink from the lower container uncovers the end 4014 of the tube, allowing air to flow up to the sealed container, reducing the vacuum there. Ink then flows down from the sealed container until the vacuum increases to the previous level sufficient to hold the head of ink.

In the arrangements described with reference to FIGS. 8 and 9, the inlet manifold of the printhead is supplied with ink by the upper reservoir 2040. However, initial filling of the printhead with ink is not easily accomplished by supplying the ink from the upper reservoir. Firstly, air in the printhead has to be flushed downwards. Secondly, air can become trapped in the printhead, which can prevent the establishment of a "syphon" effect in the lower reservoir.

It is important for the generation of the positive and negative fluid pressures that all air be expelled from the ink system and when filing the system from empty, a large volume of air must be displayed from the printhead, its manifolds and the connecting tubes. Two methods have been developed for this: both are illustrated in FIG. 10. They may be used together or as alternatives.

FIG. 10 illustrates an example of a suitable arrangement for filling the printhead using the lower reservoir. In this example, the printhead 2010 is illustrated as having a single inlet manifold 2030 and a single outlet manifold 2035, as in the example described with reference to FIG. 6. These manifolds are connected by a bypass 5010 including a bypass valve 5012, the purpose of which is described below.

During normal printing operation, ink enters the inlet manifold 2030 of the printhead from upper reservoir 2040 open to the atmosphere via air filter 2041. Valve 5012 is closed during normal printing operation, so that the ink flows from the inlet manifold, into the droplet ejection channels in the printhead and then into the outlet manifold, from which it is conveyed to the lower reservoir. The upper reservoir is supplied with ink from lower reservoir 2050 by means of a pump 2060. As in the system described with reference to FIG. 9, the pump 2060 is allowed to run continuously, with ink flowing back to the lower reservoir when the fluid level in the upper reservoir exceeds the level of outlet 4000. A filter 2095 traps any foreign bodies which may have entered the ink supply, for example, from an ink storage tank (not shown) supplying ink to the lower reservoir by means of pump 3030, with filter 3020 serving the same purpose as filter 2041.

Figure 10A:
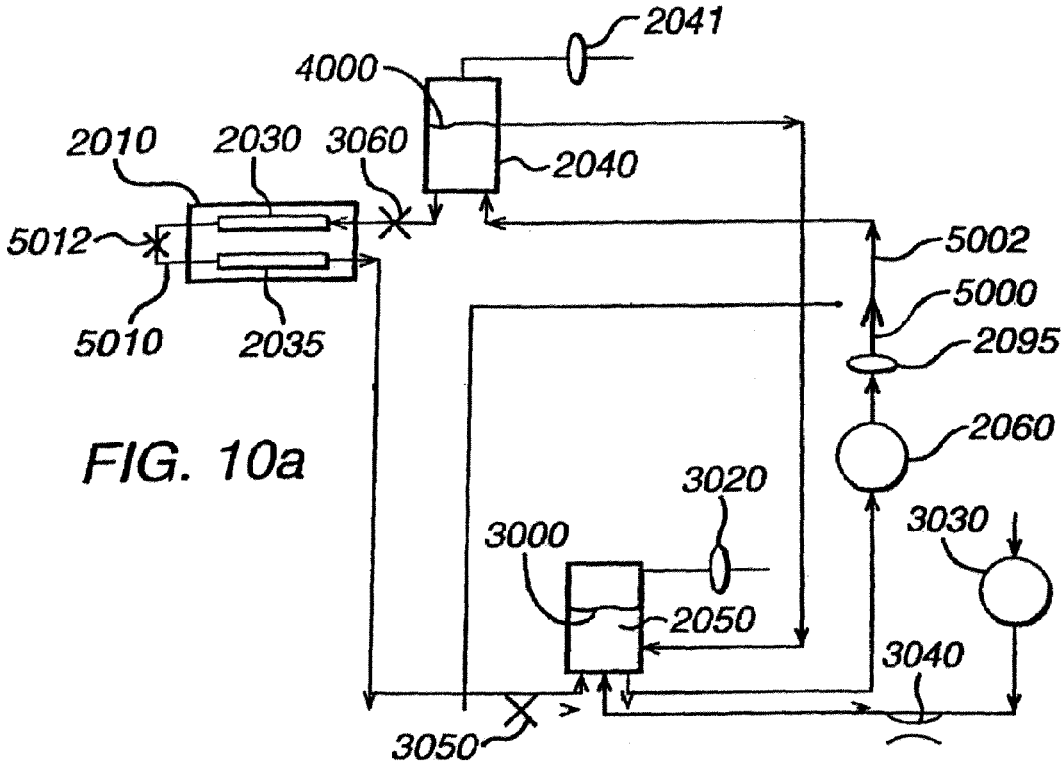

Ink passes from filter 2095 to diverter valve 5000. Diverter valve 5000 may adopt one of two positions. During normal printing operation, the diverter valve 5000 takes a first position 5002, as shown in FIG. 10*a*, so that ink is supplied to the upper reservoir 2040, as previously described.

Figure 10B:
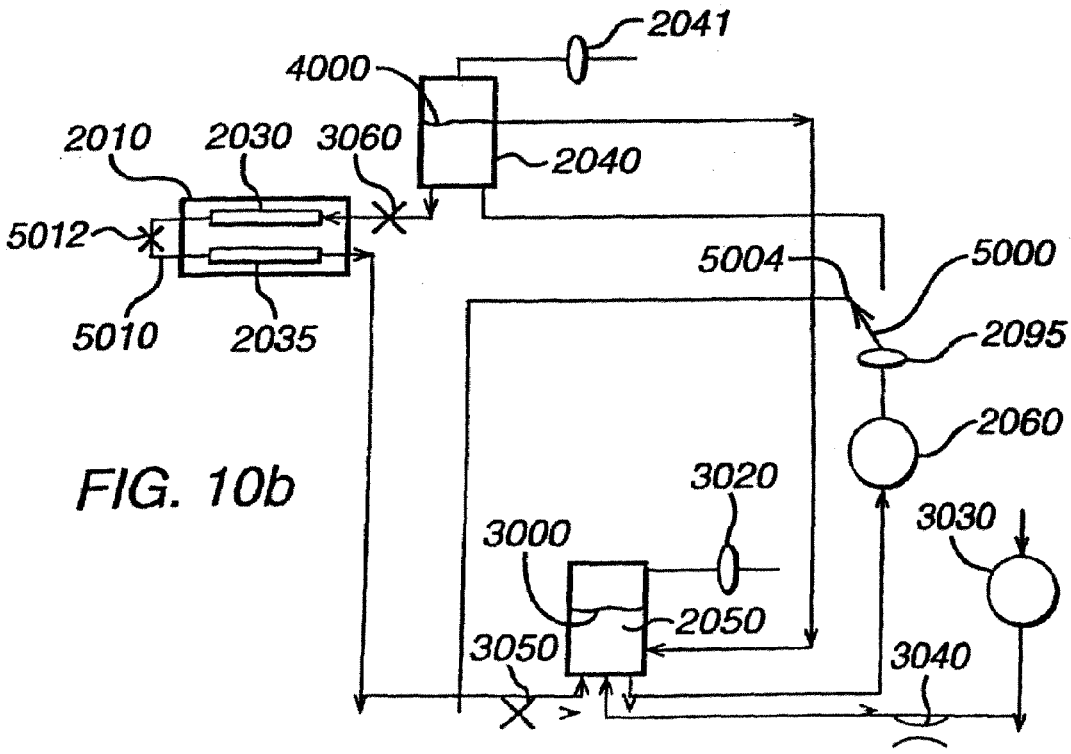

During initial filling of the printhead, the valve 3050 (which is at the lowest point of the system) is closed and the diverter valve 5000 takes a second position 5004, as shown in FIG. 10*b*. This allows the printhead to be filled from the bottom up with ink pumped from the lower reservoir. During filling, bypass valve 5012 may be opened. When open, this valve connects the inlet and outlet manifolds of the printhead at the opposite end to the connecting pipes, and thus allows fluid and air to pass from one to the other without having to pass down the printhead channels. This is a much lower impedance path, allowing higher fluid velocities and therefore permits the passage of air when it would not pass through the channels.

As described previously with reference to FIG. 8, valves 3050, 3060 are arranged in the ink supply lines to and from the printhead. These valves remain open during the printing operation, with valve 3050 being closed during the filling operation to prevent ink draining from the printhead into the lower reservoir. The valves 3050 and 3060 should have a clear bore at least equal to the bore of the connecting pipes to prevent air bubbles stalling at the entrance to the valve. A non-return valve may also be installed in the supply line from the diverter valve 5000 to the printhead, and also in the supply line to the pump 2060 where this is not of the positive displacement kind.

The bypass valve 5012 alternatively can be used for effective filling of the printhead from the upper reservoir 2040. The sequence of operations for filling the printhead by this route is as follows:

With the pump 2060 running and the upper reservoir full, the lower valve 3050 is closed, the bypass valve 5012 and the upper valve 3060 are opened. Fluid will flow into the printhead, compressing the air into the lower connecting pipe. When this has occurred, the lower valve 3050 is opened, and the air is purged (expelled) downwards by the high flowrate of ink. When all air has been removed, the bypass valve is closed and the printhead is ready for operation.

An advantage of the use of the bypass valve in either the bottom-filling or purging method is that the printhead does not weep ink from the nozzles during the filling process as there is minimal net positive pressure at the nozzles.

Another advantage is that small amounts of air may easily be purged from the system by opening the bypass valve 5012 momentarily.

Another advantage is that the system may be flushed to remove debris after connection of a printhead by opening the bypass valve 5012, without the debris-laden fluid travelling down the printhead channels and possibly blocking them.

A further refinement is the use of a bypass valve 5012 in conjunction with supply pipes to the printhead which are of the smallest practical internal bore consistent with an acceptable pressure drop down the pipes. The small bore results in a high velocity, which is more efficient in transporting air bubbles downwards and out of the system than a large bore where bubbles may stagnate.

It will be appreciated from the foregoing that the system may employ either diverter valve 5000 or bypass valve 5012, or both of them.

The temperature of the ink in the ink supply system may fluctuate for a number of reasons, for example, due to fluctuation in the ambient temperature and with the operating condition of the printhead (light or dark print). Fluctuation of the ink temperature can cause the viscosity of the ink to change. This can alter the amount of ink which is deposited in an ink droplet from the printhead, leading to undesirable variations in, for example, the size of droplets deposited by the printhead. It is therefore desirable to regulate the temperature of the ink deposited from the printhead.

Figure 11:
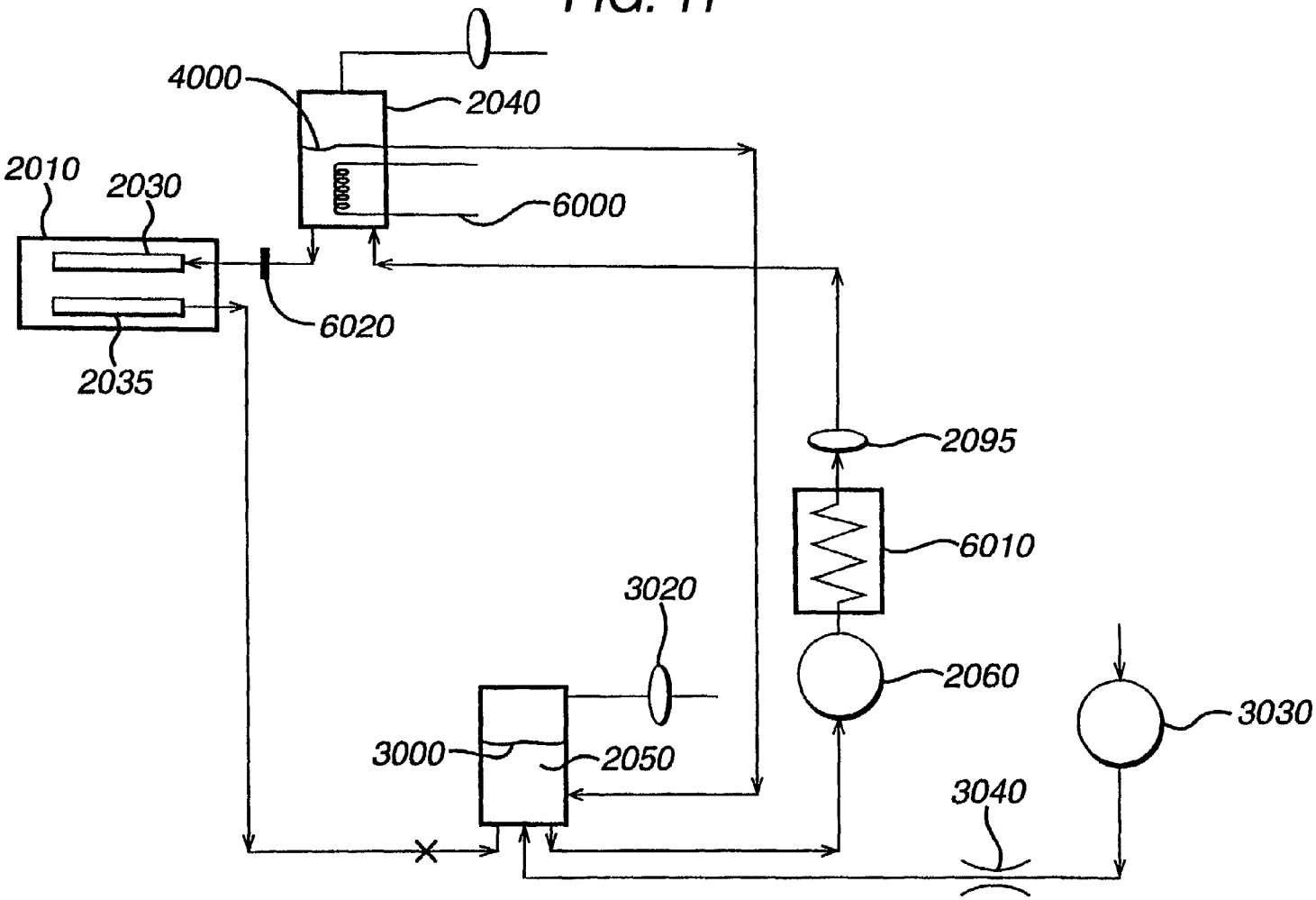

FIG. 11 illustrates an arrangement for regulating the temperature of an ink supply system. The system shown in FIG. 11 is similar to that described with reference to FIG. 10, with the diverter valve 5000, bypass 5010 and bypass valve 5012 omitted for clarity purposes only.

The system includes a heater 6000 for heating ink in the upper reservoir 2040. The heater 6000 may take any suitable form, for example, the heater 6000 may surround the upper reservoir 2040. The output of the heater 6000 is controlled by a controller (not shown) which receives an indication of the temperature of the ink output from the upper reservoir 2040 from temperature sensor 6020 located in a conduit conveying ink from the upper reservoir to the printhead.

If, for example, the ambient temperature varies from 15° C. to 30° C., and the printhead is to be operated at an optimal temperature of 40° C., the heater must be capable of heating the ink by up to 25° C. However, as described above, during operation of the printhead fluid passing through the printhead is also heated by the drive circuitry of the printhead. This can result in heating of the ink by up to 10° C. as it flows through the printhead. This can lead to a situation where heat passed from the lower reservoir to the upper reservoir is hotter than the optimal temperature. Therefore, a controllable cooling heat exchanger 6010 is installed between the pump 2060 and filter 2095 in order to reduce the temperature of the fluid conveyed to the upper reservoir as required.

Each feature disclosed in this specification (which term includes the claims) and/or shown in the drawings may be incorporated in the invention independently of other disclosed and/or illustrated features.

For example, any of the features described with reference to FIGS. 8 to 11 may be incorporated together in any suitable arrangement. For example, the heating and cooling arrangement described with reference to FIG. 11 may be used in any of the systems described with reference to FIGS. 8 and 9. Similarly, the arrangement for filling the printhead using the lower reservoir 2050 described with reference to FIG. 10 may be used in any of the systems described with reference to FIGS. 8 and 9.

What is claimed is:

1. Droplet deposition apparatus comprising:

an array of fluid chambers, each chamber communicating with an orifice for droplet ejection, a common fluid inlet manifold and a common fluid outlet manifold;

each chamber so connected with said inlet manifold and said outlet manifold as to enable a fluid flow from said inlet manifold, through each chamber in said array and into said outlet manifold, said fluid flow through each chamber being sufficient to prevent foreign bodies in the fluid from lodging in the orifice;

and each chamber being associated with a piezolelectric actuator for effecting droplet ejection from said orifice simultaneously with said fluid flow through the chamber;

wherein the flow through each chamber is at least ten times greater than the maximum fluid flow of droplets ejected through the orifice of the chamber, and the resistance to flow of said inlet and outlet manifolds is chosen such that a negative static pressure at the orifice of any chamber in the array due to the flow varies between any two chambers by an amount less than that which would give rise to significant differences in droplet ejection properties between said two chambers in the array.

2. Apparatus according to claim 1, wherein the inlet manifold has a resistance to flow less than that which would give rise to a variation in static pressure between the inlets to any two chambers in the array sufficient to produce significant differences in droplet ejection properties between said two chambers in the array.

3. Apparatus according to claim 1, wherein the resistance to flow of said outlet manifold is chosen such that the pressure at a fluid inlet to any chamber in the array varies between any two chambers by an amount less than that which would give rise to significant differences in droplet ejection properties between said two chambers in the array.

4. Apparatus according to claim 1, wherein the cross-sectional area of at least one of the inlet and outlet manifolds is such that said pressure varies between any two chambers by an amount less than that which would give rise to significant differences in droplet ejection properties between said two chambers in the array.

5. Apparatus according to claim 1, wherein the array of chambers is linear.

6. Apparatus according to claim 1, wherein said array is angled to the horizontal and said inlet manifold extends parallel to the array, the properties of said inlet manifold varying in a direction lying parallel to the array in such a way as to substantially match the rate of pressure loss along the inlet manifold due to viscous losses in the inlet manifold to the rate of increase of static pressure along the inlet manifold due to gravity.

7. Droplet deposition apparatus comprising:

an array of fluid chambers, each chamber communicating with an orifice for droplet ejection, a common fluid inlet manifold and a common fluid outlet manifold;

a piezoelectric actuator associated with each chamber for establishing an acoustic wave in fluid within the chamber to effect droplet election, and each chamber so connected with said inlet manifold and said outlet manifold as to enable, simultaneously with the establishment of an acoustic wave within the chamber to effect droplet ejection from said orifice, a fluid flow from the inlet manifold, through each chamber in said array and into said outlet manifold, said fluid flow through each chamber being sufficiently greater than the maximum flow through the orifice to prevent foreign bodies in the fluid from lodging in the orifice;

the cross-sectional of area of at least one of the inlet and outlet manifolds is such that said pressure varies between any two chambers at flow rates through each chamber of up to ten times the maximum flow through the associated orifice by an amount less than that which would give rise to significant differences in droplet ejection properties between said two chambers in the array.

8. Apparatus according to claim 7, wherein the array of chambers is linear.

9. Apparatus according to claim 7, wherein said array is angled to the horizontal and said inlet manifold extends parallel to the array, the properties of said inlet manifold varying in a direction lying parallel to the array in such a way as to substantially match the rate of pressure loss along the inlet manifold due to viscous losses in the inlet manifold to the rate of increase of static pressure along the inlet manifold due to gravity.

10. A method of droplet deposition utilizing apparatus comprising an array of fluid chambers, each chamber communicating with an orifice to define a fluid meniscus in the orifice for droplet ejection, a common fluid inlet manifold and a common fluid outlet manifold, each chamber being associated with means for effecting droplet ejection from said orifice; the method comprising the step of generating a fluid flow into said inlet manifold, through each chamber in said array and into said outlet manifold and effecting droplet ejection from a selected chamber by activating a piezoelectric actuator associated with that chamber whereby:

the fluid flow into each chamber is at least ten times greater than the maximum fluid flow of droplets deposited through the orifice;

a negative static pressure is maintained at each orifice when droplet ejection is not being effected; and the resistance to fluid flow in the inlet and outlet manifolds is sufficiently small that the position of the meniscus in each orifice when droplet ejection is not being effected does not differ across the array.

* * * * *